US012312900B2

(12) United States Patent
Hiorth

(10) Patent No.: US 12,312,900 B2
(45) Date of Patent: May 27, 2025

(54) DOWNHOLE WELL TOOL AND METHOD FOR PERMANENTLY SEALING A DOWNHOLE WELL

(71) Applicant: Interwell Norway AS, Hafrsfjord (NO)

(72) Inventor: Espen Hiorth, Trondheim (NO)

(73) Assignee: Interwell Norway AS, Hafrsfjord (NO)

( * ) Notice: Subject to any disclaimer, the term of this patent is extended or adjusted under 35 U.S.C. 154(b) by 0 days.

(21) Appl. No.: 18/572,018

(22) PCT Filed: Jun. 2, 2022

(86) PCT No.: PCT/EP2022/065057
§ 371 (c)(1),
(2) Date: Dec. 19, 2023

(87) PCT Pub. No.: WO2022/268474
PCT Pub. Date: Dec. 29, 2022

(65) Prior Publication Data

US 2024/0287866 A1 Aug. 29, 2024

(30) Foreign Application Priority Data

Jun. 25, 2021 (NO) ..... 20210826

(51) Int. Cl.
*E21B 33/12* (2006.01)

(52) U.S. Cl.
CPC ..... *E21B 33/1204* (2013.01); *E21B 33/1208* (2013.01)

(58) Field of Classification Search
CPC ..... E21B 33/1204; E21B 33/1208; E21B 33/1212; E21B 33/1216; E21B 36/04
See application file for complete search history.

(56) References Cited

U.S. PATENT DOCUMENTS 2,363,269 A * 11/1944 Schlumberger ..... E21B 33/134 166/60
5,833,001 A * 11/1998 Song ..... E21B 29/10 166/57

(Continued)

FOREIGN PATENT DOCUMENTS

CA 3100822 A1 11/2018
EP 3350409 A1 7/2018

(Continued)

OTHER PUBLICATIONS

International Search Report issued in PCT/EP2022/065057 on Aug. 19, 2022 (6 pages).

(Continued)

*Primary Examiner* — Yanick A Akaragwe
(74) *Attorney, Agent, or Firm* — Osha Bergman Watanabe & Burton LLP

(57) ABSTRACT

A downhole well tool, which permanently seals a downhole well, includes a housing, a first compartment, an expandable sealing element, a metal body, a setting system, and a fluid line. The housing has an upper housing section and a lower housing section. The first compartment is provided within housing. The expandable sealing element is provided circumferentially outside the lower housing section, thereby forming a second compartment radially inside of the expandable sealing element and radially outside of the lower housing section. The metal body is provided within the first compartment. The setting system includes a heater for melting the metal body. The fluid line provides fluid communication between the first compartment and the second compartment. The well tool is configured to be in the following states: a run state, in which the expandable sealing element is radially retracted; an intermediate state, in which the metal body has been melted by the heater and is flowing from the first compartment to the second compartment;

(Continued)

thereby expanding the expandable sealing element radially into contact with the well; and a set state, in which the melted metal from the metal body has been solidified within the second compartment.

21 Claims, 9 Drawing Sheets

(56) References Cited

U.S. PATENT DOCUMENTS

| | | | | |
|---|---|---|---|---|
| 6,474,414 | B1 * | 11/2002 | Gonzalez | E21B 33/14 166/57 |
| 7,178,602 | B2 | 2/2007 | Hiorth et al. | |
| 2003/0075341 | A1 * | 4/2003 | Kurlenya | E21B 33/134 166/387 |
| 2015/0267501 | A1 * | 9/2015 | Al-Gouhi | E21B 33/138 166/299 |

FOREIGN PATENT DOCUMENTS

| | | | |
|---|---|---|---|
| GB | 2420361 | A | 5/2006 |
| NO | 334913 | B1 | 7/2014 |
| WO | 2011/151271 | A1 | 12/2011 |
| WO | 2017/045984 | A1 | 3/2017 |
| WO | 2018/033760 | A1 | 2/2018 |
| WO | 2019/151870 | A1 | 8/2019 |
| WO | 2019/194899 | A1 | 10/2019 |
| WO | 2020/216475 | A1 | 10/2020 |

OTHER PUBLICATIONS

Written Opinion of the International Searching Authority issued in PCT/EP2022/065057 on Aug. 19, 2022 (8 pages).

Norwegian Search Report issued in No. 20210826 mailed on Jan. 21, 2022 (2 pages).

* cited by examiner

DOWNHOLE WELL TOOL AND METHOD FOR PERMANENTLY SEALING A DOWNHOLE WELL

FIELD OF THE INVENTION

The present invention relates to a downhole well tool for permanently sealing a downhole well and a method for permanently sealing a downhole well.

BACKGROUND OF THE INVENTION

Different types of downhole plugs are known. Their purpose is typically to seal off a downhole bore (for example a casing or a production tubing) during a well operation. Some downhole plugs are retrievable, i.e. after a period of time, a retrieving tool are used to retrieve the plug to topside again. Other downhole plugs are permanent plugs.

One group of plugs are often referred to as high expansion plugs. Here, the expansion rate, defined as the ratio between the outer diameter in the set state and the outer diameter in the run state, is relatively higher than for other groups of plugs. These plugs are designed to pass a relatively narrow restriction in the well and then expand to seal off the well bore below the narrow restriction.

One such plug is shown in U.S. Pat. No. 7,178,602. Here, the sealing device comprises a sealing element and supporting devices on its upper and lower sides. Each supporting device comprises a number of first supporting arms and a number of second supporting arms having their first ends pivotably connected to a supporting ring provided around the mandrel and where their second ends are pivotably connected to each other. This principle is used in the commercially available High Expansion Retrievable Bridge plug (HEX plug), sold and marketed by Interwell.

One of the HEX plugs is made for use in a 7" 29 pounds/feet well pipe, where the specification for such pipes allows the inner diameter of the pipe to vary in a range between ca 154.6-159.8 mm, i.e. a variation in the distance between the outside of the supporting arms of the plug in its set state to the inner surface of the well pipe up to 3 mm.

A further development of the above HEX plug is described in EP3350409. This principle is used in the commercially available High Temperature High Expansion bridge plug (THEX). The THEX plug handles the above variations in the inner diameter of the well pipe.

One of the variants of the THEX plug has an outer diameter Drun in the run state of 111.7 mm and a maximum outer diameter Dsetmax in the set state of 159.8 mm. Hence, the expansion ration is here 159.8/111.7=1.43.

One object of the invention is to provide a tool which is insertable through a relatively narrow restriction in a well and which is radially expandable in a relatively wider section of the well below the narrow restriction.

In plugging and abandonment (P&A) operations, permanent plugs are initially set in the well. Then, molten bismuth may be supplied above the permanent plug. Bismuth has expanding properties, i.e. the volume of the metal is larger when solidified than when molten. Hence, solidified bismuth serves as an additional barrier above the permanent plug. Typically, a relatively large amount of bismuth is required, which in turn require a relatively large heater in the well to melt the bismuth at the desired location in the well. According to the report "European Commission, Study on the EU's list of Critical Raw Materials—Final Report (2020)", bismuth is considered to be a critical raw material. Hence, one purpose of the present invention is to be able to reduce the amount of bismuth when providing a bismuth-type of barrier in a well.

Another object of the present invention is to provide an alternative P&A barrier in the well.

SUMMARY OF THE INVENTION

The present invention relates to a downhole well tool for permanently sealing a downhole well, wherein the downhole well tool comprises:

- a housing having an upper housing section and a lower housing section;
- a first compartment provided within housing;
- an expandable sealing element provided circumferentially outside the lower housing section, thereby forming a second compartment radially inside of the expandable sealing element and radially outside of the lower housing section;
- a metal body provided within the first compartment;
- a setting system comprising a heater for melting the metal body;
- a fluid line providing fluid communication between the first compartment and the second compartment;

wherein the well tool is configured to be in the following states:

- a run state, in which the expandable sealing element is radially retracted;
- an intermediate state, in which the metal body has been melted by the heater and is flowing from the first compartment to the second compartment; thereby expanding the expandable sealing element radially into contact with the well;
- a set state, in which the melted metal from the metal body has been solidified within the second compartment.

In one aspect, the downhole well tool is a millable permanent downhole well tool, which is easy to remove by a milling operation, as no parts of the well tool can be rotated relative to other parts of the well tool. In one aspect, the millable permanent downhole well tool is a millable permanent plug.

In one aspect, the downhole well tool is a high expansion well tool which typically is lowered in the run state through a restriction in the well, and thereafter expanded to its set state. If the restriction is not removed, a so-called underreamer may be used to remove the set downhole well tool.

In one aspect, the expandable sealing element comprises an elastomeric material reinforced with a fiber element structure.

The fiber element structure may comprise several fibers. The fibers may be connected to each other. The fibers may be held relative to other fibers by means of the elastomeric material of the sealing element. In one aspect, the material of the elastomeric material and the fibre element structure is heat resistant with respect to the heat from the molten metal. The fibers may be aramid fibers, carbon fibers etc.

In one aspect, the fiber element structure is determining the shape of the expandable sealing element in the intermediate state.

In one aspect, the fiber element structure is flexible. In one aspect, the expandable sealing element with its fiber element structure is folded outside of the housing in the run state.

In one aspect, the fibre element structure is applied with a sealing agent. In one aspect, the sealing agent is a polymer.

In one aspect, the expandable sealing element comprises a cylindrical contact surface in the intermediate and set states.

The cylindrical contact surface is brought into sealing contact with the inner surface of the well. Hence, the cylindrical contact surface is preventing longitudinal fluid flow in the annulus between the outside of the housing and the inside of the well.

In one aspect, the cylindrical contact surface is further preventing longitudinal movement between the well tool and the well.

In one aspect, the outer diameter of the cylindrical contact surface of the expandable sealing element in a free set state is 1.5-10% larger than the average inner diameter of the well.

The term "free set state" is referring to a state in which the well tool is not restricted, for example by the well, when set.

In one aspect, the well tool comprises a centralizer connected to the housing.

The centralizer is radially expanded into contact with the well at the desired location before or in the intermediate state, to orient the expandable sealing element with respect to the well. The centralizer may also reduce the pressure needed for expanding the sealing element in the intermediate state.

In one aspect, the centralizer comprises slips for anchoring of the well tool to the well. Hence, the centralizer is preventing longitudinal movement between the well tool and the well.

In one aspect, the heater is an electric heater.

Alternatively, the heater may be a chemical heater, for example a heater heated by means of a exothermic oxidation-reduction reaction, for example a thermite reaction.

In one aspect, the heater is provided adjacent to or within the first compartment.

In one aspect, the metal body comprises a metal or metal alloy whose volume is larger when solidified than when molten.

In one aspect, the metal body comprises a metal having or metal alloy having a melting temperature lower than the melting temperature of the housing metal.

In one aspect, the metal body comprises a bismuth or a bismuth alloy. A relatively small amount of bismuth-metal may be used.

In one aspect, the upper housing section is releasably connected to the lower housing section by a releasable securing element.

In one aspect, the securing element is a meltable securing element meltable by an auxiliary heater.

In one aspect, the securing element is a shear element, such as a shear pin.

Hence, the lower housing section and the expandable sealing element filled with solidified metal may in the set state be considered as a downhole permanent plug, while the upper housing section may be considered as a setting tool for the downhole permanent plug. The setting tool or at least parts of the setting tool may be reused.

In one aspect, the downhole well tool comprises a piston slidingly and sealingly engaged within the first compartment for displacing the molten metal from the first compartment to the second compartment in the intermediate state.

Alternatively, the molten metal will flow from the first compartment to the second compartment due to gravity.

In one aspect, the piston separates the first compartment into a first sub-compartment in which the metal body is provided and a second sub-compartment in which a pressurized gas is provided.

Hence, when the metal body is melted, the pressurized gas will move the piston, thereby causing the molten metal to flow into the second compartment via the fluid line.

In one aspect, the expandable sealing element comprises a first end sleeve and a second end sleeve, wherein the cylindrical contact surface is located longitudinally between the first end sleeve and a second end sleeve.

In one aspect, the expandable sealing element comprises a first intermediate section between the first end sleeve and cylindrical contact surface, wherein the first intermediate section is cone-shaped in the intermediate and set states.

In one aspect, the expandable sealing element comprises a second intermediate section between the second end sleeve and cylindrical contact surface, wherein the second intermediate section is cone-shaped in the intermediate and set states.

In one aspect, the setting system comprises:

- a first sleeve holder for holding the first end sleeve outside of the lower housing section;
- a second sleeve holder for holding the second end sleeve outside of the lower housing section;
- a spring biased to longitudinally displace the second sleeve holder relative to the lower housing section towards the first sleeve holder;
- a releasable securing element for preventing longitudinal displacement of the second sleeve holder relative to the lower housing section in the run state;

wherein the releasable securing element is released in the intermediate state.

According to the above, the spring will displace the second sleeve holder relative to the lower housing section towards the first sleeve holder, thereby causing or at least contributing to radial expansion of the expandable sealing element into contact with the well. This will make it easier for the molten metal to flow into the sealing element, either by gravity or by means of the piston.

In one aspect, a distance between the first end sleeve and the second end sleeve is longer in the run state than in the set state.

In one aspect, the releasable securing element is a meltable securing element, and wherein the setting system comprises an auxiliary heater for melting the meltable locking element.

In one aspect, the housing comprises a spring support for supporting the spring.

In one aspect the spring is biased between the spring support and the second sleeve holder. In one aspect, the spring support is forming a lower end of the housing.

In one aspect, the upper housing section and/or lower housing section comprises a wire channel for guiding an electric wire to the auxiliary heater and/or the heater.

In one aspect, the setting system comprises a battery unit provided in the upper housing section for supplying electric power to the auxiliary heater and/or the heater.

Alternatively, electric power may be transferred from topside via an e-line or other electric power supply line.

According to the above, it is achieved a tool which is in insertable through a relatively narrow restriction in a well and which is radially expandable in a relatively wider section of the well below the narrow restriction.

The term "upper", "above", "lower", "below" etc. are used herein as terms relative to the well. Parts referred to as "upper" or "above" are relatively closer to the top of the well than the parts referred to as "lower" or "below", which are relatively closer to the bottom of the well, irrespective of the well being a horizontal well, a vertical well or an inclining well.

The present invention also relates to a method for setting a downhole well tool in a downhole well, wherein the method comprises the steps of:

lowering the tool comprising a housing to a desired location in the downhole well;

expanding an expandable sealing element provided circumferentially outside of the housing;

supplying molten metal to a compartment outside of the housing and inside of the expandable sealing element; thereby expanding the expandable sealing element into contact with the downhole well;

allowing the molten metal to solidify within the compartment.

In one aspect, the step of supplying molten metal is comprising the steps of:

melting a metal body provided within a compartment within the housing;

moving a piston within the compartment, thereby causing the molten metal to flow from the compartment within the housing to the compartment outside of the housing and inside of the expandable sealing element.

In one aspect, the step of expanding the expandable sealing element further comprises the step of:

reducing a longitudinal distance between a first end sleeve of the expandable sealing element and a second end sleeve of the expandable sealing element, thereby radially expanding a cylindrical contact surface of the expandable sealing element between the first end sleeve and a second end sleeve

DETAILED DESCRIPTION

Embodiments of the invention will be described in detail below with reference to the enclosed drawings, wherein.

Figure 10A:
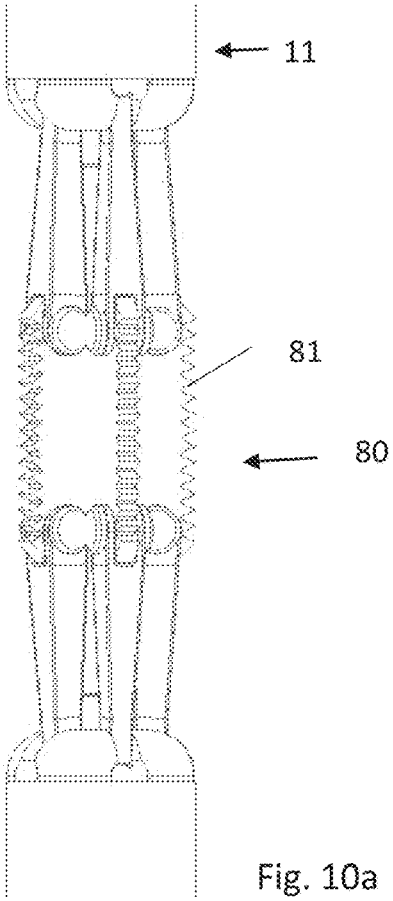
Figure 10B:
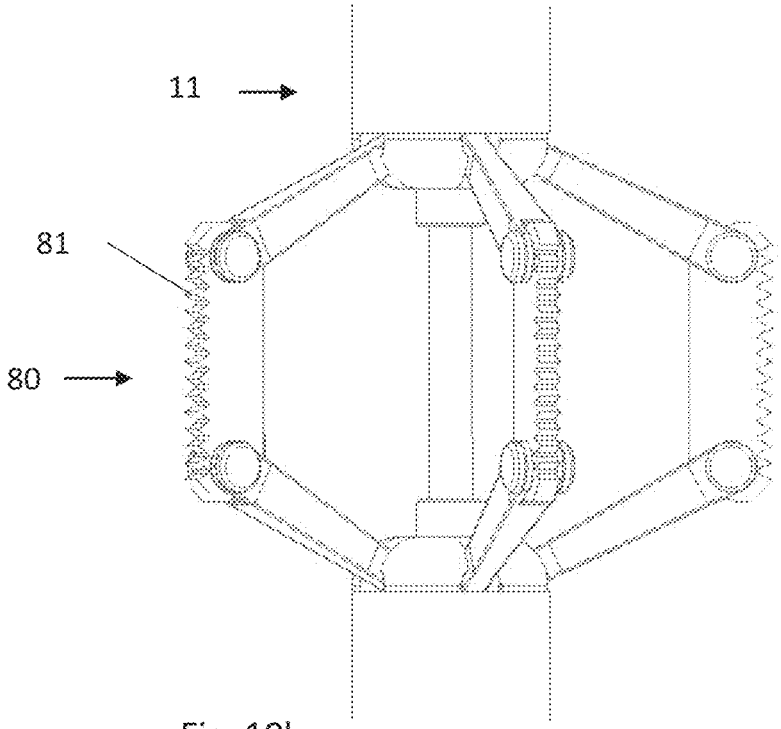
Figure 11:
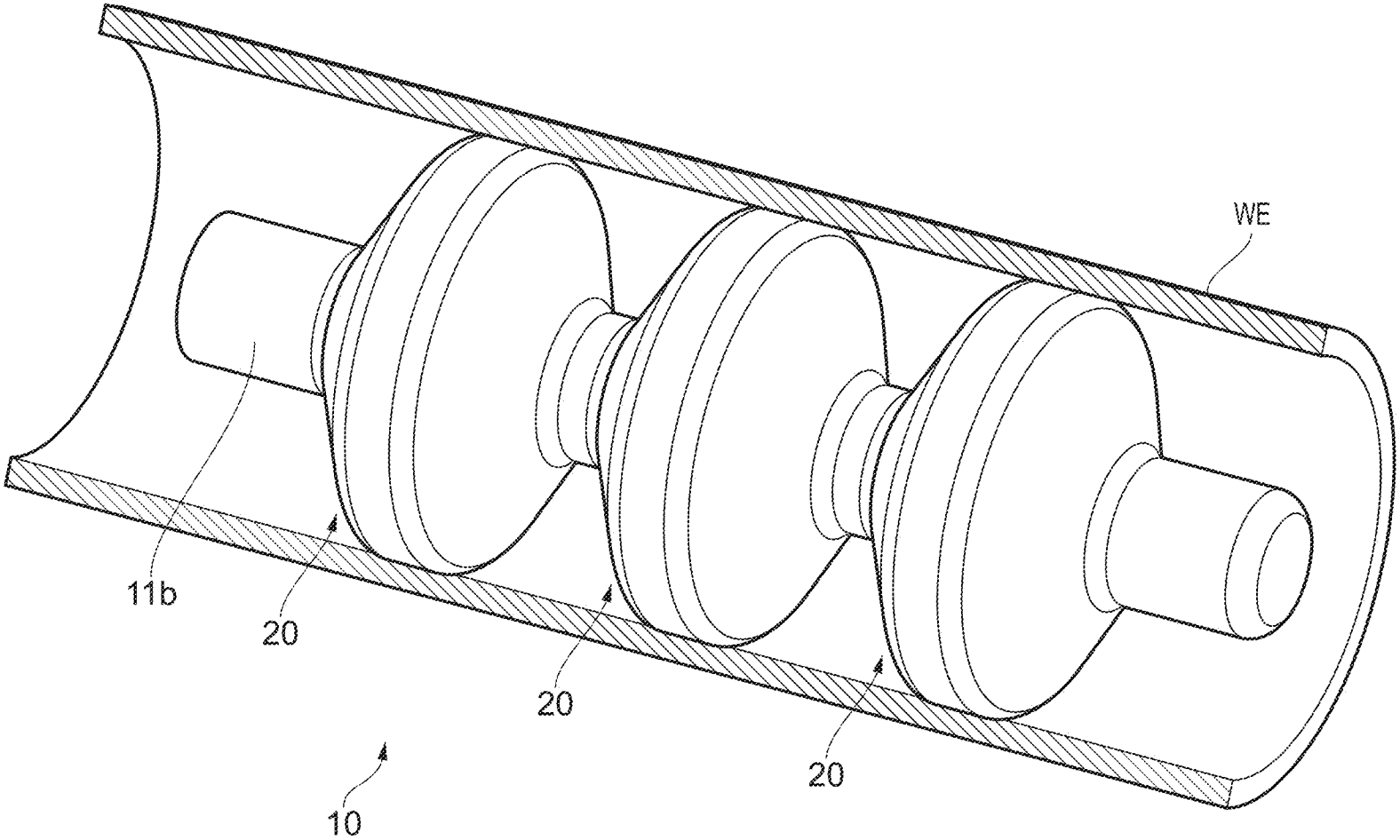

FIG. 10*a* and FIG. 10*b* illustrate a centralizer in the run and set state respectively;

FIG. 11 illustrates yet an alternative embodiment.

Figure 1:
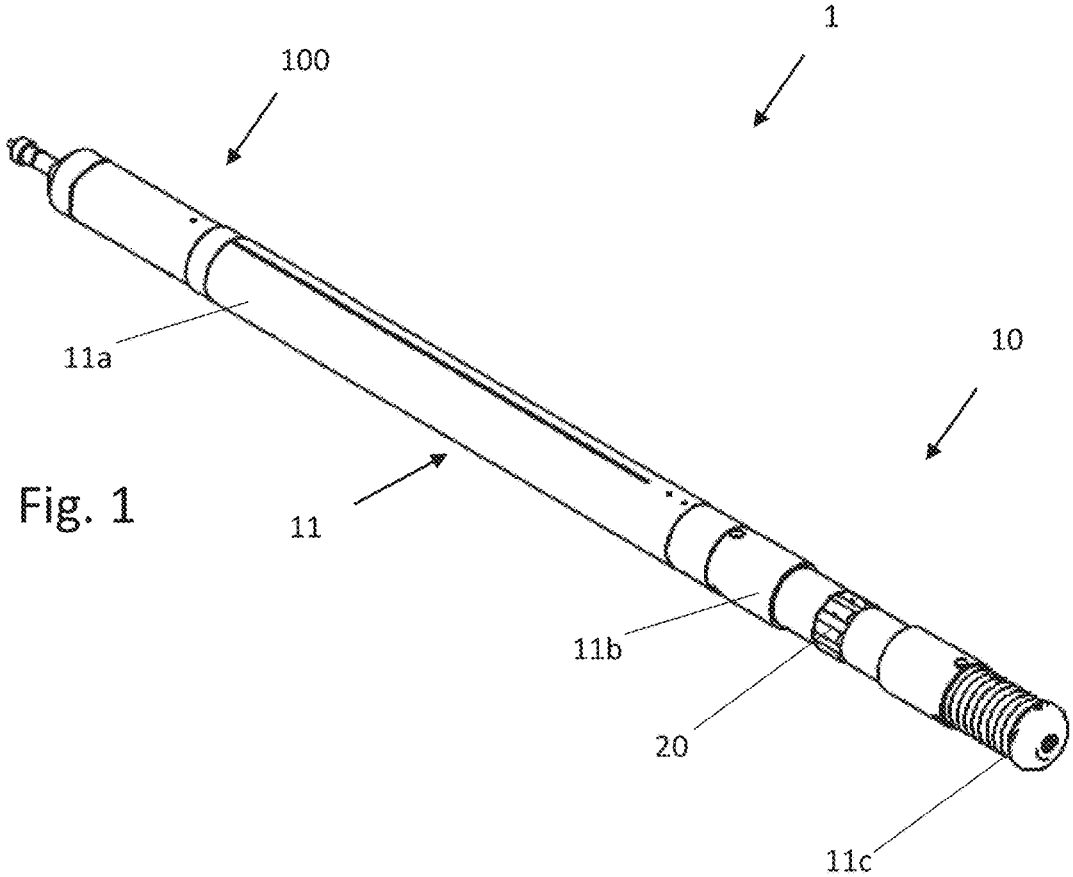
FIG. 1 is a perspective view of a permanent plug and its setting tool in its run state.

In FIG. 1, a downhole well tool 1 is shown to comprise a housing 11 having an upper housing section 11*a* and an upper housing section 11*b*. The tool 1 comprises a expandable sealing element 20 provided circumferentially outside of the lower housing section 11*b*. In FIG. 1, the expandable sealing element 20 is radially retracted, and the tool 1 is in its radially retracted state or run state.

Figure 2:
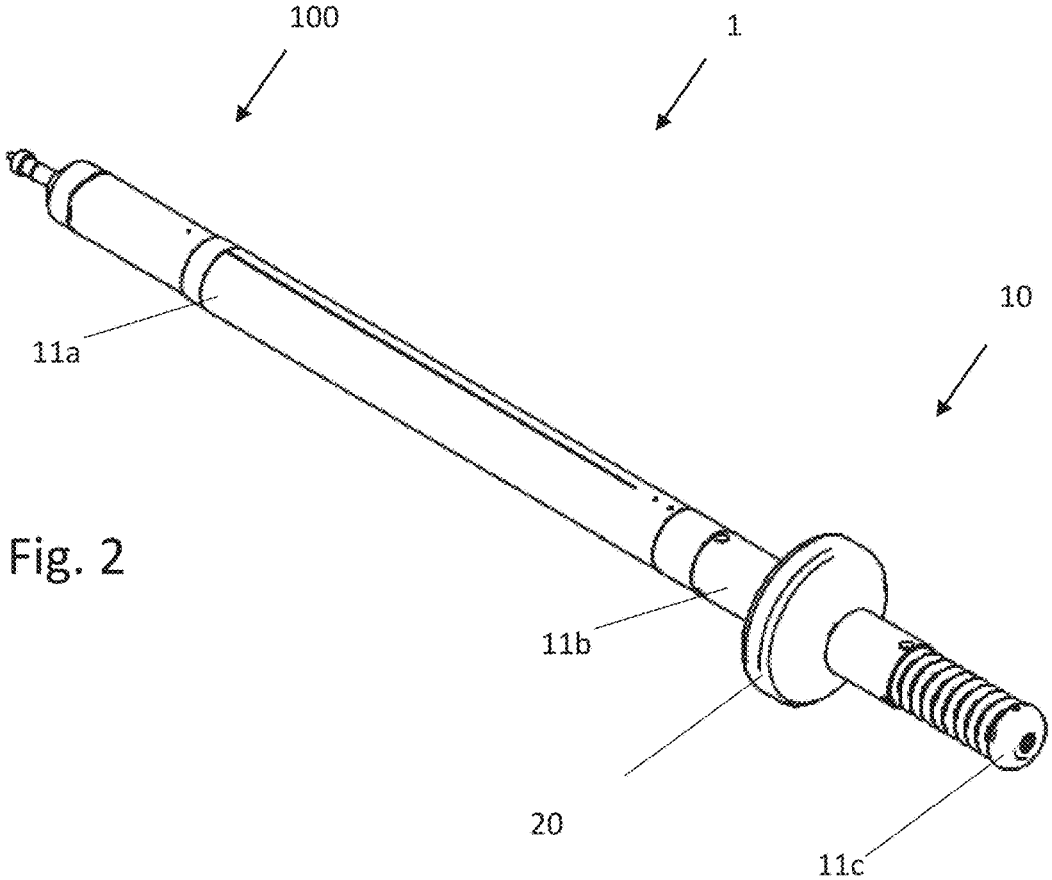
FIG. 2 is a perspective view of the permanent plug and its setting tool in its set state.

In FIG. 2, the expandable sealing element 20 is radially expanded, and the tool 1 is in its radially expanded state or set state.

Figure 3:
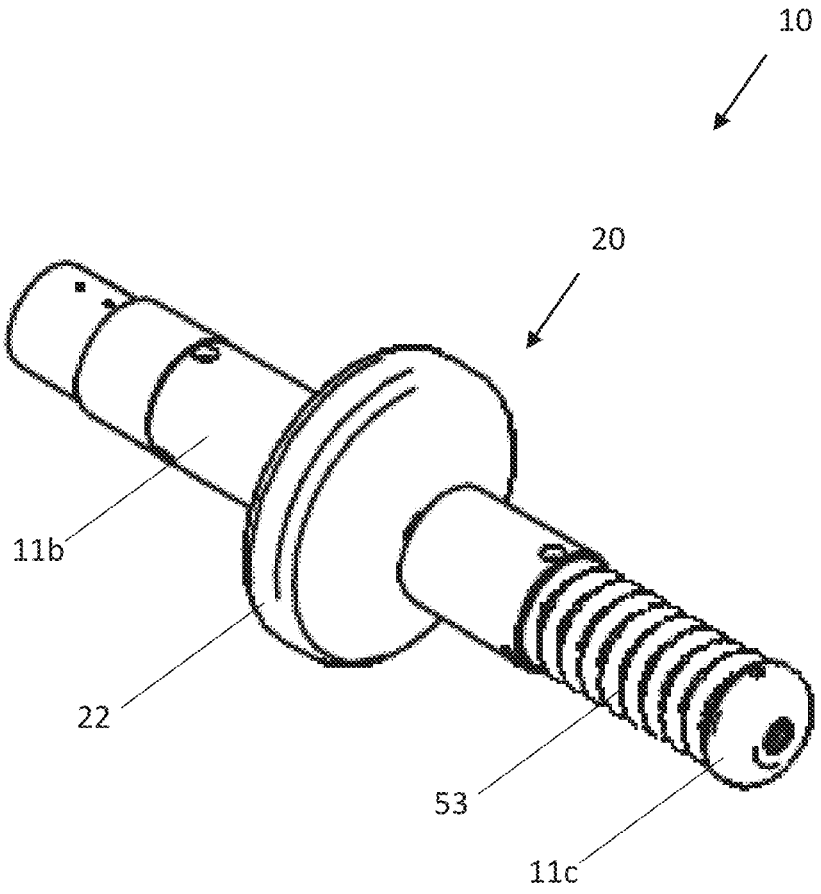
FIG. 3 is a perspective view of the permanent plug from which the setting tool has been released.

In FIG. 3, the lower housing section 11*b* has been separated from the upper housing section 11*a* and the upper housing section 11*a* has been moved away.

Figure 9:
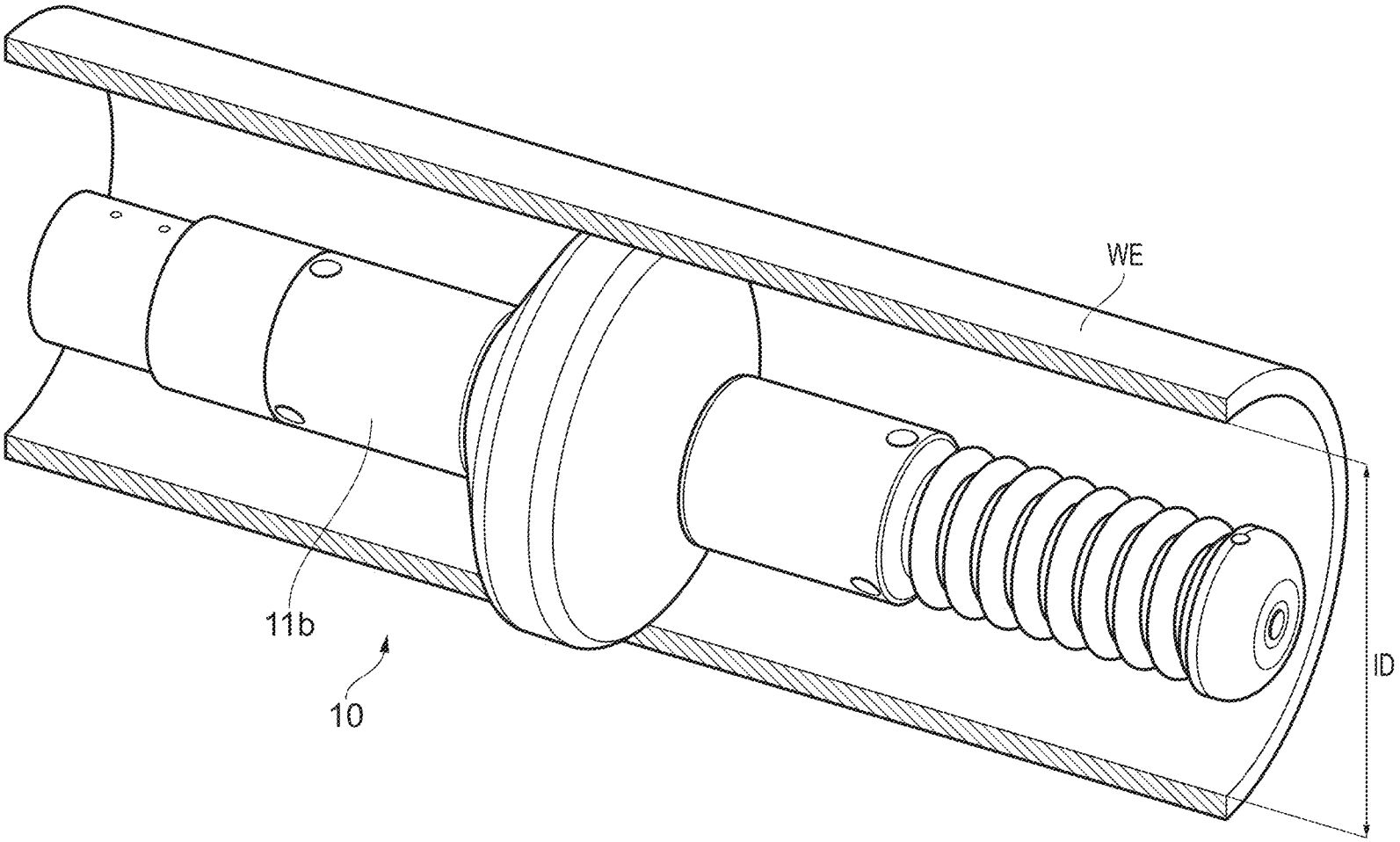
FIG. 9 illustrates a perspective side view of the permanent plug set in a well pipe.

According to the above, the downhole well tool 1 may be considered to comprise two main parts: a first part in the form of a downhole permanent plug 10 for permanently sealing a downhole well WE (the well WE is indicated in FIG. 9), and a second part in the form of a setting tool 100 which is retrieved topside after the setting operation of the downhole permanent plug 10. The setting tool 100 may then be used again to set another downhole permanent plug 10.

The Housing 11

Figure 4:
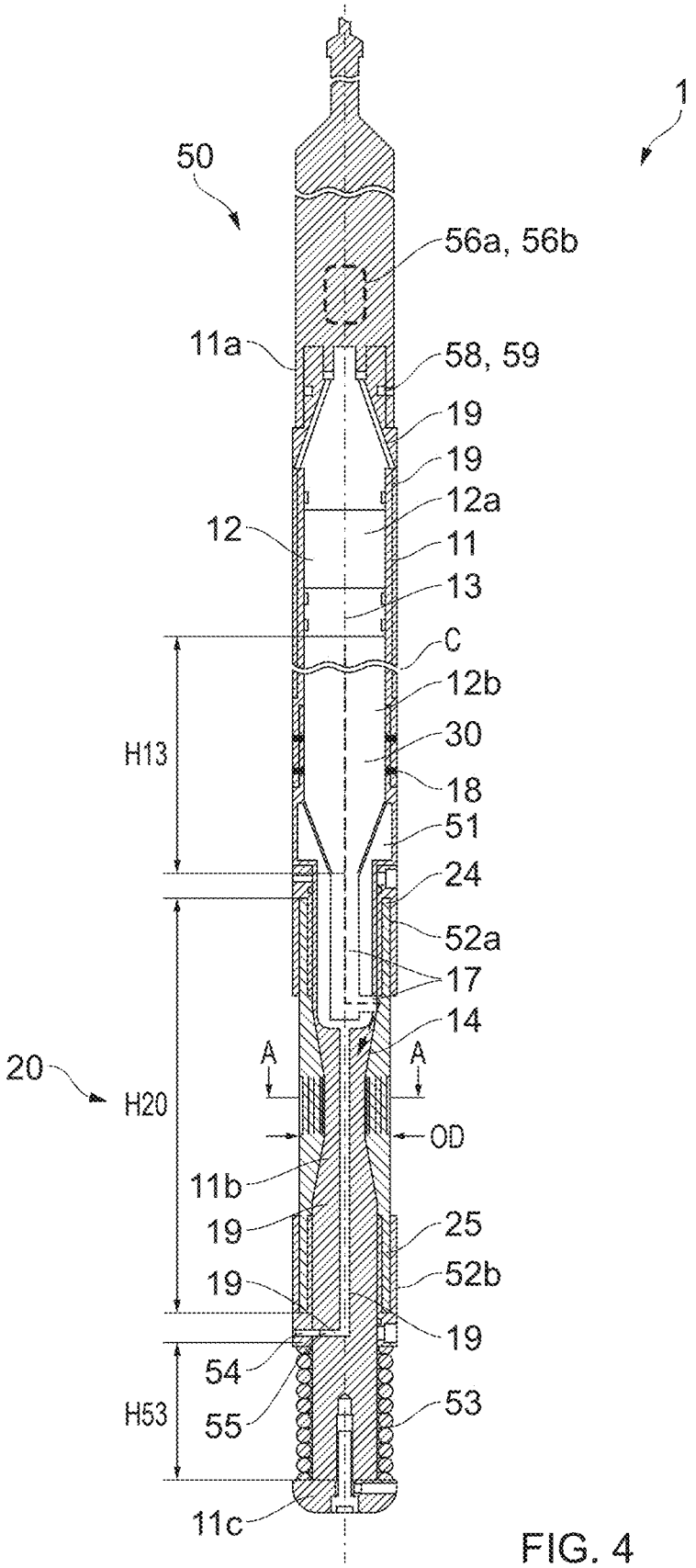
FIG. 4 shows a cross sectional side view of the permanent plug and its setting tool in its run state.

It is now referred to FIG. 4. Here, the details of the housing 11 are shown more in detail, with its upper housing section 11*a* and its lower housing section 11*b*. It is here also shown better how the expandable sealing element 20 are provided circumferentially outside of the lower housing section 11*b*.

In the upper end of the housing 11, a wireline interface 2 is shown. A longitudinal direction of the housing is indicated as a dashed line I-I in FIG. 4.

The tool 1 is defined with a first compartment 12 provided within housing 11 and a second compartment 14 radially inside of the expandable sealing element 20 and radially outside of the lower housing section 11*b*. It is further shown that the tool 1 comprises a fluid line 17 providing fluid communication between the first compartment 12 and the second compartment 14. The fluid line 17 is at least partially integrated within the housing 11.

A piston 13 is slidingly and sealingly engaged within the first compartment 12. The piston 13 separates the first compartment 12 into a first sub-compartment 12*a* and a second sub-compartment 12*b*, wherein the second sub-compartment 12*b* is located below the first sub-compartment 12*a*. The second sub-compartment 12*b* is in fluid communication with the second compartment 14 via the fluid line 17.

The upper housing section 11 *a* is releasably connected to the lower housing section 11 *b* by means of two releasable securing elements, a first, meltable securing element 59 and a shear element 18. These elements will be described further in detail below.

The housing 11 further comprises a wire channel 19 for guiding one or more electric wires inside the housing 11.

The lower end of the housing 11 further comprises a spring support 11*c*, which will also be described further in detail below.

The Expandable Sealing Element 20

Figure 5:
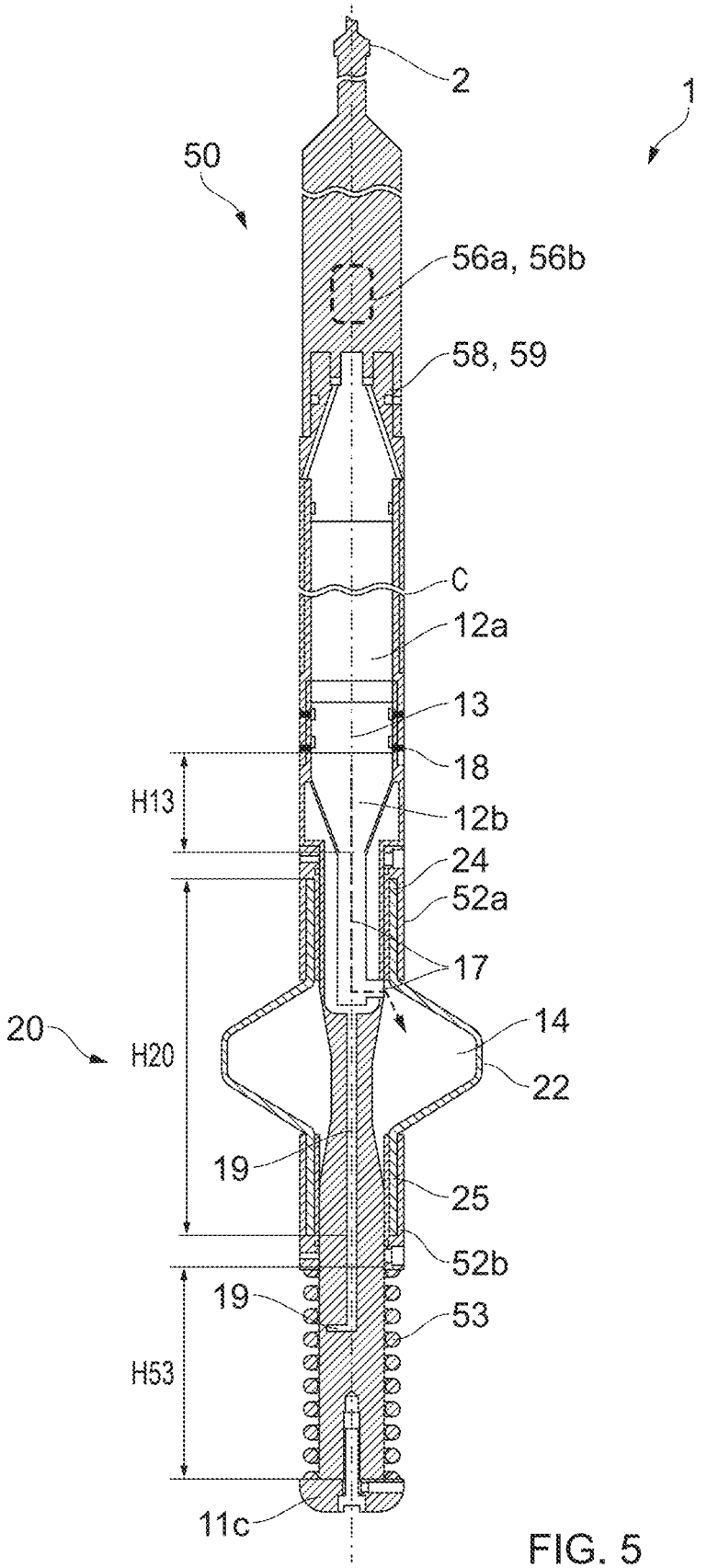
FIG. 5 shows a cross sectional side view of the permanent plug and its setting tool in its set state.
Figure 7:
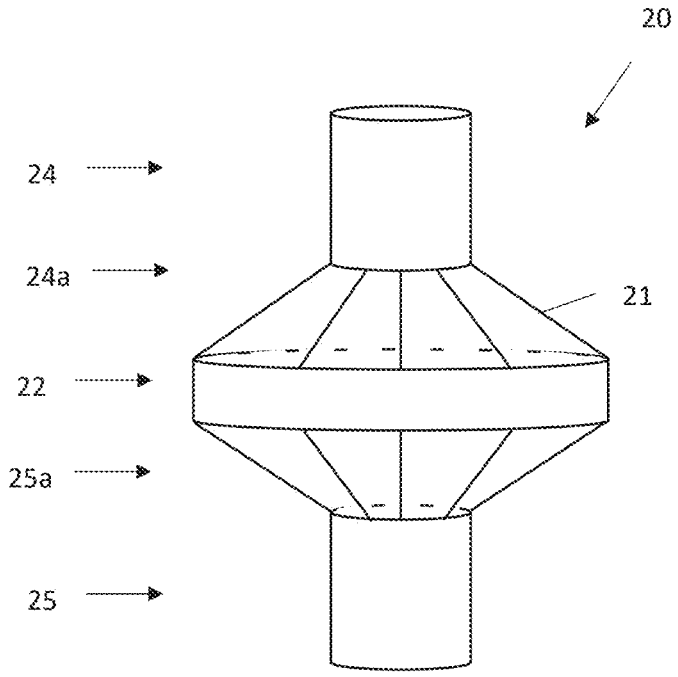
FIG. 7 illustrates a fiber element structure of the expandable sealing element.

The shape of the expandable sealing element 20 will now be described when it is in its set state as shown in FIG. 5. The expandable sealing element 20 comprises an elastomeric material reinforced with a fiber element structure 21 (FIG. 7). The purpose of the fiber element structure 21 is to reinforce the elastomeric material. In addition, the purpose of the fiber element structure 21 is to contribute to maintain the desired shape of the expandable sealing element 20 in the expanded state.

The expandable sealing element 20 is made of a heat resistant material, as will be apparent from the description below.

In FIG. 7, it is shown that the expandable sealing element 20 comprises a first or upper end sleeve 24, a second or lower end sleeve 25, and a cylindrical contact surface 22 longitudinally between the first end sleeve 24 and a second end sleeve 25. The expandable sealing element 20 further comprises a cone-shaped first intermediate section 24*a* between the first end sleeve 24 and cylindrical contact surface 22 and a cone-shaped second intermediate section 25*a* between the second end sleeve 25 and cylindrical contact surface 22.

Figure 8:
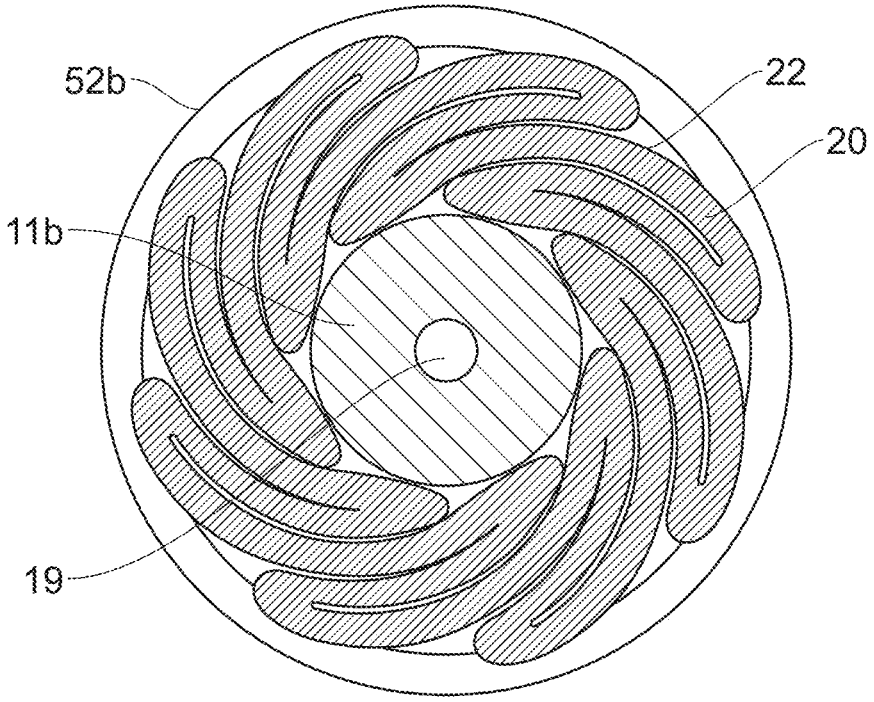
FIG. 8 illustrates a cross-sectional view of the permanent plug along line A-A in FIG. 4.

In FIG. 4 (run state), the expandable sealing element 20 may seem to be shaped like an elongated cylinder. However, this is not the case in the present embodiment. In FIG. 8, the cross section along line A-A in FIG. 4 is shown. The cylindrical contact surface 22 of the sealing element 20 has here been radially retracted by folding the cylindrical contact surface 22 outside of the lower housing section 11*b*.

Preferably, the fiber element structure 21 and the elastomeric material of the sealing element 20 is molded in the expanded state shown in FIG. 7. As part of the molding process, a sealing agent such as a water resistant polymer (silicon etc.) may be applied to the fiber element structure 21.

The Metal Body 30

The tool 1 further comprises a metal body 30 provided in the second sub-compartment 12*b*.

The metal may be a bismuth metal or a bismuth alloy. Bismuth is a metal whose volume is larger when solidified than when molten. In other words, the density of the metal in liquid form is larger than the density of the metal in solid form. In addition, it should be noted that bismuth has a relatively low melting temperature, the melting temperature is approximately 270° C. The melting temperature of the metal body is therefore considerably lower than the melting temperature of the housing metal. The housing metal of the present invention is made of cast iron (melting point approximately 1200° C.), cast steel (melting point approximately 1400° C.-1550° C.), i.e. relatively cheaper metals compared with high grade steel metals used in the above-mentioned prior art. It should be noted that also high grade steel metals may be used for the housing. In some applications, high temperature composite materials may be used for the housing.

Alternatively, the metal is another metal or metal alloy whose volume is larger when solidified than when molten and with a melting temperature of the metal body lower than the melting temperature of the mandrel metal. Other such metals are germanium (melting point 940° C.), gallium (melting point 30° C.) or alloys thereof. One example of a bismuth alloy is the so-called lead-bismuth eutectic alloy comprising 44.5% lead and 55.5% bismuth, having a melting point of 123.5° C.

Other lead/bismuth alloys are also suitable.

Another example of bismuth alloys is tin/bismuth alloys or cupper/bismuth alloys, which will increase the melting temperature to a temperature above the melting temperature of bismuth alone. Such alloys may be preferred for example in high pressure and/or high temperature wells.

It should be noted that suitable alloys may comprise more than two metals.

The above metal body 30 may be a solid body inserted into the second sub-compartment 12*b*. Alternatively, the metal body 30 may poured into the second sub-compartment 12*b* in molten form, and subsequently allowed to solidify.

The Setting System 50

The tool 1 further comprises a setting system 50 used to set the tool 1 at the desired location in the well WE.

The setting system 50 comprises a first sleeve holder 52*a* for holding the first end sleeve 24 of the expandable sealing element 20 outside of the lower housing section 11*b* and a second sleeve holder 52*b* for holding the second end sleeve 25 of the expandable sealing element 20 outside of the lower housing section 11*b*. The first sleeve holder 52*a* is secured to the lower housing section 11*b* and can be considered to be a part of the lower housing section 11*b*. The second sleeve holder 52*b* is longitudinally displaceable relative to the lower housing section 11*b*. In FIG. 4, it is further shown that the setting system 50 comprises a releasable securing element 54 for preventing such longitudinal displacement of the second sleeve holder 52*b* relative to the lower housing section 11*b*.

The setting system 50 further comprises a spring 53 biased to longitudinally displace the second sleeve holder 52*b* relative to the lower housing section 11*b* towards the first sleeve holder 52*a*. The spring 53 is biased between the abovementioned spring support 11*c* and the second sleeve holder 52*b*.

In the present embodiment, the releasable securing element 54 is a meltable securing element. The setting system 50 comprises an auxiliary heater 55 for melting the meltable locking element 54.

In FIG. 4, it is shown that the setting system 50 comprising a main heater 51 which purpose is to melt the metal body 30. The main heater 51 may be located adjacent to the second sub-compartment 12*b* as indicated in FIG. 4, or may be located within the second sub-compartment 12*b*.

The setting system 50 further comprises an auxiliary heater 58 located adjacent to the meltable securing element 59.

The setting system 50 further comprises a control circuit 56 *a* and a battery unit 56 *b* provided in the upper housing section 11 *a* for controlling and supplying electric energy to the main heater 51, the auxiliary heater 55 and the auxiliary heater 58 via electric wires provided within the wire channel 19.

Operation of the Downhole Well Tool 1

The run state, in which the tool 1 is run or lowered into the well WE, is shown in FIGS. 1 and 4. The tool 1 is also in this run state when transported from a manufacturing location to the well location and when handled topside. It should be noted that a compression band may be provided outside of the expandable sealing element 20 during transport and handling, to keep the sealing element 20 as shown in FIG. 7 and for protecting the sealing element 20 from damages.

As shown in FIG. 4, there is a height H13 (in the longitudinal direction) between the lower side of the piston 13 and the lower end of the compartment 12, there is a height H20 (in the longitudinal direction) of the expandable sealing element 20 and there is a height H53 (in the longitudinal direction) of the spring.

The first sub-compartment 12*a* is filled with a pressurized gas. This pressurized gas will not move the piston 13, due to the metal body 30 in the second sub-compartment 12*b*.

Then, in an intermediate state, the main heater 51 is supplied with electric energy and the metal body will start to melt. The auxiliary heater 55 is also supplied with electric energy, causing the meltable securing element 54 to melt and thereby releasing the second sleeve holder 52*b*. The spring 53 will now displace the second sleeve holder 52*b* relative to the lower housing section 11*b* towards the first sleeve holder 52*a*, thereby causing or at least contributing to radial expansion of the expandable sealing element 20. Preferably, the fiber element structure 21 will contribute to this radial expansion of the expandable sealing element 20, as the fiber element structure 21 will try to obtain its original shape (FIG. 7).

When the metal body has been melted by the heater 51 the piston 13 will be allowed to move and the gas pressure in the first sub-compartment 12*a* will push the piston 13 down, causing the molten metal to be displaced from the second sub-compartment 12*b* into the second compartment 14, i.e. the expandable sealing element 20 will be filled with molten metal. The flow path for the molten metal from the second sub-compartment 12*b* via the fluid line 17 into the compartment 14 is indicated by a dashed arrow both in FIG. 4 and FIG. 5. If the expandable sealing element 20 has not been fully expanded by the movement of the sleeve holder 52*b* and the properties of the fiber reinforcement structure 21, the expandable sealing element 20 will become expanded as it becomes filled with molten metal. The expandable sealing element 20 will expand until it comes into contact with the inner surface of the well WE. It should be noted that the expandable sealing element 20 will not be damaged by the molten metal due to its heat resistant properties.

It should be noted that the housing 11 (and hence the compartment 12) is longer than indicated in the drawings, as indicated by the break line C in FIG. 4 and FIG. 5. Hence, the volume of the metal body 30 in FIG. 4 may appear to be smaller than the volume of the compartment 14 in FIG. 5. It should be noted that the metal body 30 should have a volume sufficiently large to fill the entire compartment 14'.

As shown in FIG. 5, the height H20 is shorter in fig. the intermediate state than in the run state, the height H13 is shorter in the intermediate state than in the run state and the height H53 is longer in the intermediate state than in the run state.

Figure 6:
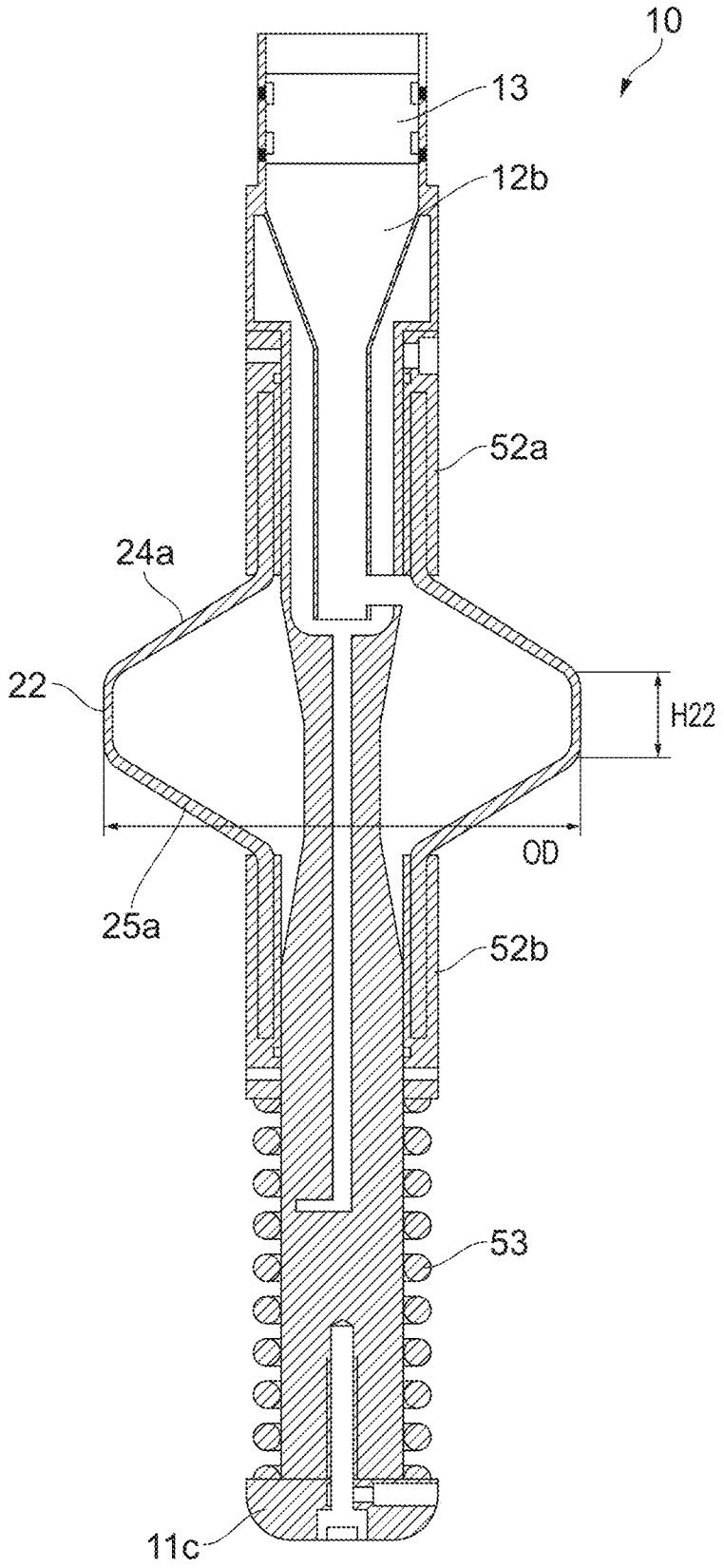
FIG. 6 shows a cross sectional side view of the permanent plug from which the setting tool has been released.

It is now referred to FIG. 6 and FIG. 3. Here, the molten metal has from the metal body 30 has been solidified within the second compartment 14, as indicated by wavy lines. It should be noted that also the flow line 17 and parts of the second sub-compartment 12*b* will contain solidified metal. This is referred to as the set state.

Due to the expanding properties of the metal or metal alloy during solidification, the solidified metal will also exert a force from the outer surface of the solidified metal to the inner surface of the well, thereby forming an anchoring of the tool relative to the well.

The cylindrical contact surface 22 is brought into sealing contact with the inner surface of the well WE. Hence, the cylindrical contact surface 22 will prevent longitudinal fluid flow in the annulus between the outside of the housing 11 and the inside of the well WE. It is also shown that this cylindrical contact surface 22 has an extension in the longitudinal direction, as indicated by a height H22. Hence, the cylindrical contact surface 22 forms an area where friction between the cylindrical contact surface 22 and the well WE will prevent longitudinal movement of the tool 1 relative to the well WE.

It should be noted that the outer diameter OD of the expandable sealing element 20 in the set state (indicated in FIG. 6) is considerably larger than the outer diameter OD of the of the expandable sealing element 20 in the run state (indicated in FIG. 4). In the present embodiment, the outer diameter OD in the set state is approximately 2.5 times the outer diameter in the run state. As a comparison, the prior art HEX bridge plug has a corresponding OD in the set state is approximately 1.3-1.8 times the OD in the run state.

It should further be noted that the outer diameter OD of the cylindrical contact surface 22 of the expandable sealing element 20 in a free set state is 1.5-10% larger than the average inner diameter ID of the well WE, to ensure that the expandable sealing element 20 is allowed to expand properly into contact with the well and to ensure that the solidified metal is allowed to exert a force from the outer surface of the solidified metal to the inner surface of the well.

It is further shown in FIG. 3 and FIG. 6 that the upper housing section 11*a* has been released from the lower housing section 11*b* by pulling the upper housing section 11*a* upwardly, causing the shear element 18 to be sheared off.

An alternative way is to supply electric energy to the auxiliary heater 58, causing the releasable securing element 59 to melt.

In both of the above occasions, the control circuit 56*a* and the battery unit 56*b* will be retrieved to surface together with the upper housing section 11*a*.

Alternative Embodiments

In the embodiment above, the upper housing section 11*a* and other parts of the well tool 1 is retrieved topside after setting of the lower housing section 11*b* and the expandable sealing element 20. However, it should be noted that the downhole well tool 1 may be a non-separatable tool, where the entire tool 1 will be left in the well WE.

It is now referred to FIG. 10*a* and FIG. 10*b*. Here it is shown a centralizer 80 which may be connected to the housing 11. The centralizer 80 may have centralizing properties only, in which the purpose is to centralize the housing 11 relative to the well WE. Here, the centralizer may be connected to the upper housing section 11*a* or to the lower housing section 11*b*.

The centralizer 80 may have anchoring properties in addition to the centralizing properties, by equipping the centralizer with teeth 81 engaging the well WE in the intermediate and set states. Also here, the centralizer may be connected to the upper housing section 11*a* or to the lower housing section 11*b*. However, in high pressure wells, the centralizer is preferably connected to the lower housing section 11*b*.

It should be noted that the piston 13 is not necessarily an essential feature, as the molten metal may flow from the first compartment 12 to the second compartment 14 by means of gravity.

It should further be noted that electric power may be transferred from topside via an e-line or other electric power supply line. Hence, the control circuit 56*a* and the battery unit 56*b* may be located topside and is not a part of the tool 1.

It should also be noted that a chemical heater may be used instead of, or in addition to, an electric heater.

It is now referred to FIG. 11. Here it is shown that the well tool 1 comprises three sealing elements 20, each sealing element 20 being filled with molten metal during the setting process and thereafter having allowed the molten metal to solidify.

The invention claimed is:

1. A downhole well tool for permanently sealing a downhole well, wherein the downhole well tool comprises:

a housing having an upper housing section and a lower housing section;

a first compartment provided within the housing;

an expandable sealing element provided circumferentially outside the lower housing section, thereby forming a second compartment radially inside of the expandable sealing element and radially outside of the lower housing section;

a metal body provided within the first compartment;

a setting system comprising a heater for melting the metal body;

a fluid line providing fluid communication between the first compartment and the second compartment;

wherein the well tool is configured to be in the following states:

a run state, in which the expandable sealing element is radially retracted;

an intermediate state, in which the metal body has been melted by the heater and is flowing from the first compartment to the second compartment; thereby expanding the expandable sealing element radially into contact with the well;

a set state, in which the melted metal from the metal body has been solidified within the second compartment.

2. The downhole well tool according to claim 1, wherein the expandable sealing element comprises an elastomeric material reinforced with a fiber element structure.

3. The downhole well tool according to claim 2, wherein the fiber element structure determines the shape of the expandable sealing element in the intermediate state.

4. The downhole well tool according to claim 1, wherein the expandable sealing element comprises a cylindrical contact surface in the intermediate and set states.

5. The downhole well tool according to claim 4, wherein the outer diameter of the cylindrical contact surface of the expandable sealing element in a free set state is 1.5-10% larger than the average inner diameter of the well.

6. The downhole well tool according to claim 1, wherein the well tool comprises a centralizer connected to the housing.

7. The downhole well tool according to claim 1, wherein the heater is an electric heater.

8. The downhole well tool according to claim 1, wherein the metal body comprises a metal or metal alloy whose volume is larger when solidified than when molten.

9. The downhole well tool according to claim 1, wherein the metal body comprises a metal or metal alloy having a melting temperature lower than the melting temperature of the housing.

10. The downhole well tool according to claim 1, wherein the metal body comprises a bismuth or a bismuth alloy.

11. The downhole well tool according to claim 1, wherein the upper housing section is releasably connected to the lower housing section by a releasable securing element.

12. The downhole well tool according to claim 1, wherein the downhole well tool comprises a piston slidingly and sealingly engaged within the first compartment for displacing the molten metal from the first compartment to the second compartment in the intermediate state.

13. The downhole well tool according to claim 12, wherein the piston separates the first compartment into a first sub-compartment in which the metal body is provided and a second sub-compartment in which a pressurized gas is provided.

14. The downhole well tool according to claim 1, wherein the expandable sealing element comprises a first end sleeve and a second end sleeve, wherein the cylindrical contact surface is located longitudinally between the first end sleeve and the second end sleeve.

15. The downhole well tool according to claim 14, wherein the setting system comprises:

a first sleeve holder for holding the first end sleeve outside of the lower housing section;

a second sleeve holder for holding the second end sleeve outside of the lower housing section;

a spring biased to longitudinally displace the second sleeve holder relative to the lower housing section towards the first sleeve holder;

a releasable securing element for preventing longitudinal displacement of the second sleeve holder relative to the lower housing section in the run state;

wherein the releasable securing element is released in the intermediate state.

16. The downhole well tool according to claim 15, wherein the releasable securing element is a meltable securing element, and wherein the setting system comprises an auxiliary heater for melting the meltable locking element.

17. The downhole well tool according to claim 15, wherein the housing comprises a spring support for supporting the spring.

18. The downhole well tool according to claim 1, wherein the upper housing section and/or the lower housing section comprises a wire channel for guiding an electric wire to the auxiliary heater and/or the heater.

19. The downhole well tool according to claim 1, wherein the setting system comprises a control circuit and a battery unit provided in the upper housing section for controlling the supply of electric energy to the heater and/or auxiliary heaters.

20. A method for setting a downhole well tool in a downhole well, wherein the method comprises:

lowering the tool comprising a housing to a desired location in the downhole well;

expanding an expandable sealing element provided circumferentially outside of the housing;

melting a metal body provided within a compartment within the housing;

moving a piston within the compartment within the housing, thereby causing molten metal to flow from the compartment within the housing to a compartment outside of the housing and inside of the expandable sealing element;

thereby expanding the expandable sealing element into contact with the downhole well;

allowing the molten metal to solidify within the compartment.

21. The method according to claim 20, wherein the expanding the expandable sealing element further comprises:

reducing a longitudinal distance between a first end sleeve of the expandable sealing element and a second end sleeve of the expandable sealing element, thereby radially expanding a cylindrical contact surface of the expandable sealing element between the first end sleeve and the second end sleeve.

* * * * *